US005156709A

United States Patent [19]

Mammino et al.

[11] Patent Number: 5,156,709

[45] Date of Patent: Oct. 20, 1992

[54] FUSIBLE WHITE STRIPE TRANSPARENCY SHEETS

[75] Inventors: Joseph Mammino, Penfield; John G. Van Dusen, Walwerth, both of N.Y.

[73] Assignee: Xerox Corporation, Stamford, Conn.

[21] Appl. No.: 737,875

[22] Filed: Jul. 30, 1991

[51] Int. Cl.[5] ..... B41M 5/00

[52] U.S. Cl. ..... 156/235; 428/195; 428/206; 428/327; 428/913

[58] Field of Search ..... 428/195, 913, 216, 412, 428/212, 206, 327; 430/18, 97, 126; 156/235

[56] References Cited

U.S. PATENT DOCUMENTS

| | | | |
|---|---|---|---|
| 3,852,093 | 12/1974 | O'Leary | 503/202 |
| 4,032,687 | 6/1977 | Hornsby, Jr. | 428/1 |
| 4,637,974 | 1/1987 | Kubit | 430/126 |
| 4,818,742 | 4/1989 | Ellis | 503/201 |
| 4,837,061 | 6/1989 | Smits et al. | 428/40 |

*Primary Examiner*—B. Hamilton Hess
*Assistant Examiner*—W. Krynski
*Attorney, Agent, or Firm*—Oliff & Berridge

[57] ABSTRACT

A coating composition composed of a polymer pigment combined with an emulsion or latex binder forms a white stripe when coated on a transparency. The white stripe becomes transparent upon fusing.

10 Claims, 1 Drawing Sheet

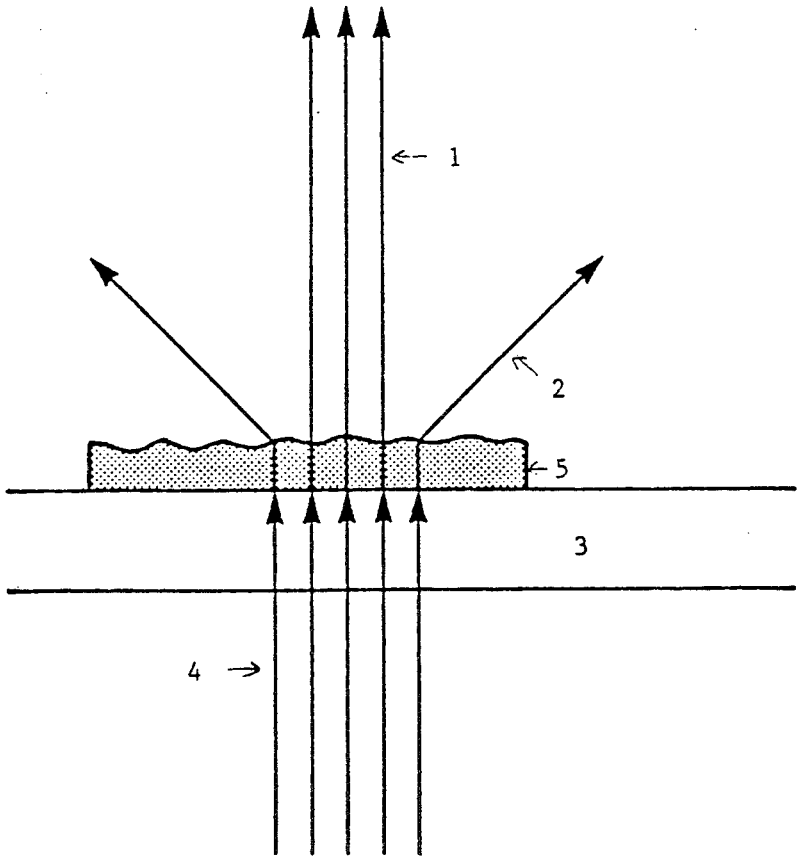
FIGURE

FUSIBLE WHITE STRIPE TRANSPARENCY SHEETS

The present invention is directed to a method of preparing a composition useful for coating transparency sheets.

BACKGROUND OF INVENTION

As the term is used herein, "transparency sheets" are substrates formed of transparent material, generally in the form of sheets, on which an image can be created for use with equipment which is capable of projecting the image by the transmission of light through the substrate. A "transparency" is generally a transparency sheet on which an image has been printed. When images printed on transparency sheets are used by printing machines, such as photocopiers, laser printers, ink jet printers or thermal transfer printers, with optical sheet detection capability, it is necessary that they have an indicator such as a white stripe affixed to them in order for the sheet to be detected by the machine. Generally, however, this white stripe is opaque, and thus projects black when light is applied to the printed transparency sheet. When this occurs, image information printed on the transparency sheet in the area of the white stripe will not be visible on the projected image, because the portion of the transparency sheet treated with the white stripe will project black. Thus, a transparency sheet which is capable of being detected optically but which also permits all image information on the transparency sheet to be projected is needed.

U.S. Pat. No. 3,852,093 to O'Leary discloses a transparent colored film product, which becomes clear and colorless at image areas when heated thermographically. This film contains a p-quinoneimine color body and a mild reducing agent. The p-quinoneimine color bodies, supplied in a matrix of film-forming binder as a coating on paper, transparent film, etc., undergo decolorization when heated at thermographically induced temperatures in reactive association with a mild reducing agent. Brief heating of the film product causes migration of at least one of the reactants and results in a decolorization of the color body at the heated areas to form an image. The product is said to be useful in making negative color projection transparencies.

U.S. Pat. No. 4,818,742 to Ellis discloses a heat responsive recording element having a recording layer containing a colorless di- or tri- aryl compound having a closed ring moiety incorporating the meso carbon atom and containing a nitrogen atom directly bonded to both the meso carbon and an arylating group that has a displaceable entity. Upon heating the recording layer, the arylating group effects intramolecular arylation of the nitrogen atom with irreversible breaking of the meso carbon atom-nitrogen atom bond, thus rendering the compound colored in the imagewise heating pattern.

U.S Pat. No. 4,837,061 to Smits et al. discloses a laminated tamper-evident structure which exhibits an irreversible color change upon delamination. The patent discloses a structure which includes a laminate of at least two layers capable of generating a color by a light interference and absorption phenomenon that requires direct and intimate contact between adjacent layers. Upon separation of the layers of the laminate, the color generated by the contact between the two layers is irreversibly lost, providing evidence that the structure has been tampered with.

U S Pat. No. 4,032,687 to Hornsby, Jr. discloses an applique, attachable by a pressure sensitive adhesive, which includes a base sheet, a layer of color changeable liquid crystalline material disposed upon the base sheet, and a transparent covering layer overlying the liquid crystalline layer. The applique is color changeable by the application of heat to the liquid crystalline layer.

SUMMARY OF THE INVENTION

It is an object of the invention to provide a transparency sheet which permits sheet detection capabilities without blocking information on the transparency.

It is a further object of the invention to provide a process for preparing a transparency which permits sheet detection without interfering with information on a transparency.

These and other objects are provided by a transparency sheet wherein a white stripe is printed or coated thereon. The white stripe composition is capable of becoming transparent upon the application of heat and/or pressure, preferably heat and pressure.

BRIEF DESCRIPTION OF THE DRAWINGS

The FIGURE is a diagram of the specular and diffuse components of transmitted light.

DETAILED DESCRIPTION OF PREFERRED EMBODIMENTS

In accordance with the present invention, a transparency sheet is provided with a fusible optically detectable (e.g., substantially opaque) pattern thereon. The pattern can be made transparent (i.e., substantially transparent to visible light) by the application of heat and/or pressure, for example, during image fixing in the fusing portion of a printing machine, e.g. a xerographic printing machine such as a photocopier or laser printer. This invention thus enables sheet detection capability to be provided in a transparency sheet without concomitant interference with or obliteration of information contained on the transparency sheet.

Preferably, the pattern has an opacity value of 25% to greater than about 80%, more preferably 40% to greater than about 80%, when measured by an opacimeter such as the Huygen Model 2100 Digital Opacimeter. Upon application of heat and/or pressure, this opacity value is reduced to from about 15% to less than about 5%, preferably from about 12% to less than about 5%. Opacity value is defined as the ratio (percentage) of two reflectance measurements: the reflectance of a sample with a black backing divided by the reflectance with a white backing. In a particularly preferred embodiment, the stripe is white, although most other colors are also acceptable.

The pattern is preferably in the form of a stripe about 0.5 inch or less wide located along one edge of the transparency sheet, typically along the long edge. However, it may be in other equivalent shapes, sizes and/or locations depending upon the configuration of the optical detector(s) in the printing machine within which the transparency sheet is to be used. For convenience, but without limitation, the optically detectable pattern will generally be referred to herein as a "white stripe".

A composition useful for forming a white stripe of the invention on a transparency sheet may comprise an emulsion, dispersion, latex or water soluble polymer binder wherein polymer pigment particles are dispersed. This composition form a substantially opaque coating on the transparency sheet when the coating of the composition is dried. The polymer pigment particles of the composition are capable of fusing with the binder upon the application of heat and/or pressure, preferably heat and pressure, the composition becoming transparent upon fusing. The pigment polymer and binder polymer may be the same, or different, material.

The opaque property of the composition is generated by the dispersion of a fine-sized powder of small polymer pigment particles within a liquid carrier, which is generally a binder material, such as an emulsion, dispersion, latex or water soluble polymer binder. The binder must be in a carrier liquid that is a non-solvent for and will not destroy the particulate nature of the polymer pigment particles. Liquids such as alcohols, ketones, and esters may be used alone or in combination with water. The polymer pigment particles are thermoplastic, and have an index of refraction identical to or closely matching that of the binder material, and average diameters ranging from 0.1 to 40 micrometers, preferably 0.1 to 25 micrometers.

The polymer pigment particles may be formed by any suitable means. For example, they may be formed directly from emulsion or dispersion polymerization processes after removing the carrier liquid; from polymers dissolved in solvent and precipitated with non-solvents; the may be ground, milled, jetted, extruded, spray dried etc. under suitable mechanical conditions and temperature alone or in any combination of the above to generate the particle size of interest.

Because the polymer pigment particles have an index of refraction which is very similar to that of the binder material used, there is very little scattering of light after fusing because of differences of refraction or light scattering centers in the two materials.

The amount of opacity of the coating formed by the composition can be measured by a determination of its Projection Efficiency (PE) to provide an objective measure of the projection quality of a transparency. An ideal transparency is one wherein all transmitted light is projected, i.e., PE is 100%. (A transparency wherein all transmitted light is scattered would have a PE of 0%.) To determine the PE, it is first necessary to measure two components of transmitted light: a specular (P) component 1 which continues normal to the plane of the substrate 3, and a diffuse (N) component 2 which is directed away from the normal. (See FIG. 1.) Only the P component comprises "useful" transmitted light from the incident beam 4; the N component does not reach the lens and is lost. Smooth dyed films have low N component losses and consequently project bright colors well. The muddying of projected colors by poorly fused xerographic transparencies is caused by large N-component losses rather than to low total (P+N) transmission.

The relative magnitude of the N component is dependent upon scattering processes occurring in the image layer 5. Scattering occurs when the light beam crosses randomly-oriented interfaces between materials of different refractive indices, primarily binder-pigment and binder-air interfaces. The magnitude of the binder-pigment scattering is determined by the optical properties of the pigment and the binder, as well as by the degree of dispersion of the former in the latter. (It decreases with improving pigment dispersion and approaches zero for a dye system.) The binder-pigment scattering is therefore essentially fixed for a given composition, but the binder-air scattering, which is due to a rough image surface and air spaces between discrete pigment particles, is directly controlled by the fusing subsystem. In the absence of offsetting, higher temperatures and longer dwell times reduce the binder-air scattering by smoothing the image surface as well as coalescing the particles into a homogeneous mass.

The polymer pigment particles used in the invention are preferably colorless, having no absorption in the visual wavelengths. However, because they are a component of a dispersed-phase system, wherein the polymer pigment particles are subdivided and distributed throughout the liquid carrier, the polymer particles which have sufficiently large mass will scatter light and thus appear opaque. Coatings which are substantially opaque but become transparent after fusing may be obtained by selecting compatible polymer pigment and binder polymer materials with about the same refractive index.

The glass transition temperature ($T_g$) temperature for the polymer pigment particles is preferably 35°-80° C., and ideally 45°-65° C. Materials useful for the polymer pigments may include polyurethanes, polyesters, polytetrafluoroethylene and other fluorocarbon polymers, polycarbonates, polyarylethers, polybutadiene and copolymers thereof with styrene, vinyl/toluenes, acrylates, polysulfones, polyethersulfones, polyaryl sulfones, polyethylene and polypropylene, polyimides, poly(amideimides), polyetherimides, polyethylpentene, polyphenylene sulfides, polystyrene and its acrylonitrile copolymers, polyvinylchloride and polyvinyl acetate copolymers and terpolymers, silicones, acrylics and copolymers thereof with styrene, alkyds, amino polymers, cellulosic resins and polymers, epoxy resins and esters, nylon and other polyamides, phenoxy polymers, phenolic polymers, phenylene oxides, polyvinylidene fluoride, and polyvinyl fluoride. Preferred polymer pigments are polyesters, polybutadiene and copolymers thereof with styrene, vinyl-toluene, acrylates, polystyrene and its acrylonitrile copolymers, polyvinylchloride and its polyvinyl acetate copolymers and terpolymers, acrylics and copolymers thereof with styrene, epoxy resins and esters.

The polymer pigment particles are dispersed homogeneously within the binder material by methods known in the art for pigment dispersion. Such methods include, but are not limited to, blending, roll milling, ball milling, sand milling, impingement milling, three roll milling, impeller milling, dispersers and sonifiers.

Materials useful for the binder material may include an emulsion binder, which comprises a dispersion of an immiscible liquid in another, or a dispersion binder which comprises a finely divided solid, liquid, or gas in a continuous medium. They may include such polymeric materials as vinyl acetate homopolymers, vinyl acetate acrylate polymers, polystyrene, styrene-acrylonitrile or styrene-acrylate copolymers, styrene-butadiene-acrylonitrile terpolymers, polyvinylchloride, vinyl chloride-vinyl acetate copolymers, vinylidene-chloride-acrylonitrile or vinylidene chloride-vinyl-acetate copolymers, polyvinylidene chloride, polyacrylates, polyvinyltoluene, epoxy, polyurethane, polyester alkyd emulsions, polyvinylpyrrolidone, polyvinyl ethers and maleic anhydride copolymers, polyvinyl pyridines, polyvinyl alcohol, water or alcohol soluble cellulose polymers, polyacrylic acid, polyvinyl acetate crotonic acid copolymers and the like.

A dried coating of this composition is rendered transparent by the dissolution or fusing and leveling of the polymer pigment particles with the binder vehicle, on the application of heat and/or pressure, preferably heat and pressure. The light scattering sites of the polymer pigment particles are eliminated by the fusing process which causes the polymer pigment particles to flow and coalesce together. Discontinuities at the interface of the polymer binder and pigment are also reduced. Air voids are also reduced. Particles lose their irregular shape, and scattering centers are removed.

In order to produce a composition which will become transparent, the materials used for the binder material and polymer pigment should be compatible, i.e., have characteristics, such as the same refractive index and ability to combine as discussed below, such that the application of heat and/or pressure, preferably heat and pressure, will produce the desired opacity after treatment. Incompatibility between the binder and polymer pigment will produce a phase separation of the materials of the composition which will produce light scattering. (Thus, despite appearing transparent, they will project gray because of the light scattering which occurs.) To be considered compatible, the materials must be able to combine in such a manner that any interface between the materials will not scatter light. For example, it has been found that when a vinyl acetate polymer binder material is combined with polymethylmethacrylate polymer pigment material and heat is applied, these materials will provide a fusing sufficient to produce a substantially transparent (i.e., approximately 10% opacity) material. Completely transparent coatings may be obtained by selecting compatible polymer pigment and binder polymer materials.

This invention also provides a method of applying an optically detectable white stripe on a transparency sheet, wherein polymer pigment particles are dispersed in an emulsion, dispersion, latex or water soluble polymer binder to form an opaque composition. The polymer pigment particles of the composition are capable of fusing with the binder upon the application of heat and/or pressure, with the fused composition being transparent. The composition is then applied in a predetermined pattern on a transparency sheet by a known method such as spraying, gravure coating, dip coating, or silk screen techniques.

Drying conditions after the composition is applied to the transparency include vacuum, air drying, impingement drying, etc. Temperatures should be maintained below the glass transition temperature of the polymer pigment so that the pigment integrity is preserved.

The coating composition, coating process, and drying conditions may be designed to increase light scattering centers in the dried white stripe. For example, the carrier solvent mixture may be formulated to cause "blushing" and "blooming", the coating process may be designed to entrap air, cause surface bubbles, roughness, cratering, or the drying conditions may be designed to influence "orange peel" effects (e.g. via Benard convection), etc. These are typically considered defects in coatings, but may be advantageous in the present invention. The fusing process should remove these light scattering centers to level the coating for transparency.

The invention further includes a process of forming an image on a transparency sheet. In this process, a transparency sheet of the invention is fed through a printing machine using optical detection of the white stripe on the sheet. In an image forming area of the printing machine, a marking material such as a toner is applied in an image pattern in a known manner without regard to the presence or location of the white stripe. In a fusing area of the printing machine, heat and/or pressure, preferably heat and pressure, is applied to the transparency sheet, thereby binding the image to the sheet. A solvent fuser may also be employed as an equivalent of a heat and/or pressure fuser. The white stripe is preferably rendered transparent in this step, although it may be rendered transparent in a subsequent higher temperature and/or pressure step if desired, depending on the respective fusing properties of the marking material and the white stripe coating composition. After the fusing step in which the white stripe becomes transparent, any necessary further sheet sensing may preferably be accomplished physically, for example by a known metal wire microswitch.

In the heat-fusing step of this process which renders the white stripe transparent, the temperature of the substrate is increased to the glass transition temperature ($T_g$) of the polymer pigment particles, similarly to fusing of toner images. Fusing temperatures should be low, typically 145°-225° C., and preferably 171°-193° C. It is preferable to keep the dwell time in the fuser as low as possible, with a maximum of up to 1-2 seconds, but more preferably 10 ms to less than 155 ms, and typically 60 ms to 110 ms. This may be accomplished by placing the substrate in an oven or, alternatively, passing the transparency sheet over heating elements located in the printing machine, such as a fuser roller. Flash fusing, radiant and convection heat fusing may also be performed.

In the heat and pressure fusing embodiment of this process, pressure ranging from 0.1 lb/in to 1000 lbs/in may be applied. In a preferred embodiment, pressure ranging from 1.0 lb/in to 100 lbs/in is applied. Where only pressure is applied, pressure ranging from 50 lbs/in to 1000 lbs/in is preferably applied.

The invention will further be illustrated in the following, non-limiting examples, it being understood that these examples are intended to be illustrative only and that the invention is not intended to be limited to the materials, conditions, process parameters and the like recited herein.

EXAMPLE 1

1 g of Ucar Latex 133, a vinyl acetate homopolymer at 60 wt % solids available from Union Carbide Corporation, 5 ml of deionized water, and 1 g of submicron sized polymethylmethacrylate (PMMA) polymer are placed into a 2 oz. glass jar, and roll milled for 1 hour with 3 mm glass beads. The resulting coating material is then applied onto a transparency film using a #10 wire draw down rod, and air dried for about 15 minutes. The coating is opaque when dried and resembles the white stripe used on a Xerox Corporation transparency sheet type 3R2780. The opacity is measured using a Technidyne, BNL-3 Opacimeter. Opacity values of 45-50% are recorded. A portion of the film is cut and put into an oven at about 150° C. for about 5 seconds. The white PMMA pigment fuses to produce a substantially transparent coating. Opacity values for the heated sample average 11%.

EXAMPLE 2

1 g of Ucar 376, a vinyl acetate acrylate polymer available from Union Carbide Corporation, 5 ml of deionized water, and 1 g of PMMA polymer pigment coating are combined and coated on a substrate as in Example 1. The coating is opaque when dried and resembles the white stripe used on a transparency sheet. The opacity is measured as in Example 1, and opacity values of 40–45% are recorded. A portion of the film is cut and put into an oven at about 150° C. for about 5 seconds. The white PMMA pigment fuses to produce a substantially transparent coating, with opacity values of 8–9%.

EXAMPLE 3

2 g of Hycar 26349 an acrylic latex from B.F. Goodrich Company, 10 ml of deionized water and 2 g PMMA polymer pigment are placed into a glass jar and roll milled for 1 hour with 3 mm glass beads. The coating composition is coated on a substrate as in Example 1. The coating is opaque and white when dried and may be rendered transparent by heating to about 150° C. for about 30 seconds.

EXAMPLES 4–8

| | | Polymer Pigment | |
|---|---|---|---|
| Example | Binder | Particle | Size |
| 4 | Acrysol-TT615 | Polyester | 10 μm |
| 5 | PVP-K26/28 | Polyester | 10 μm |
| 6 | Hycar 26349 | Polyester | 10 μm |
| 7 | Hycar 26349 | Styrene-Butadiene | 12 μm |
| 8 | Hycar 26349 | Styrene-Acrylate | 12 μm |

The polyester pigment particle is the polymeric reaction condensation product of 2,2-bis(4-hydroxyisopropoxy-phenyl)propane and fumaric acid having a melt index of about 10 to 14. Acrysol-TT615 is an acrylic latex from Rohm and Haas Company. PVP-K26/28 is polyvinylpyrrolidone available from GAF Corporation. The coating composition is 2 g binder, 10 g deionized water and 2 g of polymer pigment particles. The coatings are prepared as in Example 3 with similar results, except that the coating quality is not as good.

While the invention has been described with reference to particular preferred embodiments, the invention is not limited to the specific examples given, and other embodiments and modifications can be made by those skilled in the art without departing from the spirit and scope of the invention.

What is claimed is:

1. A transparency sheet comprising a transparent substrate bearing an optically detectible stripe which becomes transparent upon application to said transparency sheet of at least one member selected from the group consisting of heat and pressure.

2. The transparency sheet of claim 1, wherein said optically detectable stripe is formed from a composition of polymer pigment particles and a binder.

3. The transparency sheet of claim 1, wherein said binder is selected from the group consisting of vinyl acetate homopolymers, vinyl acetate acrylate polymers, polystyrene, styrene-acrylonitrile or styrene-acrylate copolymers, styrene-butadiene-acrylonitrile terpolymers, polyvinylchloride, vinyl chloride-vinyl acetate copolymers, vinylidene-chloride-acrylonitrile or vinylidene chloride-vinyl-acetate copolymers, polyvinylidene chloride, polyacrylates, polyvinyltoluene, epoxy resins, polyurethane, polyester alkyd emulsions, polyvinylpyrrolidone, polyvinyl ethers and maleic anhydride copolymers, polyvinyl pyridines, polyvinyl alcohol, water or alcohol soluble cellulose polymers, polyacrylic acid, polyvinyl acetate crotonic acid copolymers, and polyvinyl chloride-polyvinylidene chloride copolymers.

4. The transparency sheet of claim 2, wherein said polymer pigment particles and said binder have substantially the same refractive index.

5. The transparency sheet of claim 2, wherein said polymer pigment particles are colorless.

6. The transparency sheet of claim 1, wherein the opacity value of said transparency sheet after application of said member is less than 15%.

7. A method of forming an image on a transparency sheet, comprising:

feeding a transparency sheet containing an optically detectible pattern through a printing machine using optical detection of said pattern;

forming an image on said transparency sheet in said printing machine; and applying at least one member selected from the group consisting of heat and pressure to said transparency sheet in said printing machine;

thereby binding said image to said sheet and making said pattern transparent.

8. The method of claim 7, wherein the step of binding said image to said sheet and making said pattern transparent is accomplished by the same application of at least one member selected from the group consisting of heat and pressure to said transparency sheet.

9. The method of claim 7, wherein said pattern is formed in the shape of a stripe.

10. The method of claim 9, wherein said stripe becomes transparent upon the dissolution, fusion or leveling of polymer pigment particles dispersed in a binder that together comprise the stripe.

* * * * *